US010699607B2

(12) United States Patent
Rackley et al.

(10) Patent No.: US 10,699,607 B2
(45) Date of Patent: Jun. 30, 2020

(54) BILLBOARD PRINT MATERIAL AND INSTALLATION METHOD

(71) Applicant: R2 Billboards, LLC, Boulder, CO (US)

(72) Inventors: Roderick R. Rackley, Boulder, CO (US); Hank Ridless, San Francisco, CA (US)

(73) Assignee: R2 Billboards, LLC, Boulder, CO (US)

( * ) Notice: Subject to any disclaimer, the term of this patent is extended or adjusted under 35 U.S.C. 154(b) by 0 days.

(21) Appl. No.: 16/384,705

(22) Filed: Apr. 15, 2019

(65) Prior Publication Data

US 2019/0325793 A1 Oct. 24, 2019

Related U.S. Application Data

(60) Provisional application No. 62/659,497, filed on Apr. 18, 2018.

(51) Int. Cl.
*G09F 15/00* (2006.01)

(52) U.S. Cl.
CPC ..... *G09F 15/0018* (2013.01); *G09F 15/0025* (2013.01); *G09F 15/0037* (2013.01)

(58) Field of Classification Search
CPC ..... G09F 15/0018; G09F 15/0025; G09F 15/0037
See application file for complete search history.

(56) References Cited

U.S. PATENT DOCUMENTS 4,862,615 A * 9/1989 Hillstrom ..... G09F 15/0018 40/603
5,685,054 A * 11/1997 Yasnogorodskiy .... B65H 16/00 242/557
6,092,319 A * 7/2000 Hicks ..... G09F 21/048 40/590
6,453,591 B1 * 9/2002 Siener ..... B29C 43/305 40/594
6,782,646 B1 * 8/2004 Devaney ..... G09F 15/0025 40/590
2003/0200685 A1 * 10/2003 Gibb ..... G09F 15/0025 40/603
2004/0200103 A1 * 10/2004 Dombrowski ..... G09F 15/00 40/603
2005/0188572 A1 * 9/2005 Haggard, Jr. ..... G09F 7/12 40/604
2006/0156601 A1 * 7/2006 Haggard, Jr. ..... G09F 15/0025 40/604
2006/0185205 A1 * 8/2006 Black ..... G09F 15/0025 40/603
2006/0222828 A1 * 10/2006 Sinto ..... D06N 3/042 428/195.1
2008/0120877 A1 * 5/2008 Farrell ..... G09F 13/04 40/564

(Continued)

*Primary Examiner* — Gary C Hoge
(74) *Attorney, Agent, or Firm* — Sheridan Ross P.C.

(57) ABSTRACT

A billboard advertising apparatus and installation method include an under-layer base and an overlying image layer. The under-layer provides an opaque white surface to a billboard panel as well as protection for the overlying image layer. The image layer is a thin translucent color layer with advertising or message copy. With the presence of a base or under-layer, the cost to make the image layer may be significantly reduced.

10 Claims, 8 Drawing Sheets

(56) References Cited

U.S. PATENT DOCUMENTS

| | | | | |
|---|---|---|---|---|
| 2010/0078959 | A1* | 4/2010 | Goodson | B60J 11/00 296/136.07 |
| 2012/0144709 | A1* | 6/2012 | Markee | G09F 3/10 40/671 |
| 2012/0159822 | A1* | 6/2012 | Gibb | G09F 15/0012 40/606.01 |
| 2014/0106139 | A1* | 4/2014 | Abrams | C09J 7/29 428/200 |
| 2016/0229032 | A1* | 8/2016 | Moren | B24D 3/34 |
| 2016/0232823 | A1* | 8/2016 | Carolan | G09F 15/00 |
| 2017/0221392 | A1* | 8/2017 | Taylor | G09F 9/301 |
| 2017/0335807 | A1* | 11/2017 | Yun | B01D 46/0005 |

* cited by examiner

BILLBOARD PRINT MATERIAL AND INSTALLATION METHOD

CROSS-REFERENCE TO RELATED APPLICATION

This application claims the benefit of priority from U.S. Provisional Patent Application Ser. No. 62/659,497, filed Apr. 18, 2018, entitled "BILLBOARD PRINT MATERIAL AND INSTALLATION METHOD," the entire disclosure of which is hereby incorporated by reference in its entirety.

FIELD OF THE INVENTION

The present invention is directed at a new, inexpensive printable material and a novel installation method that will dramatically reduce the installed cost of traditional printed billboards.

BACKGROUND OF THE INVENTION

In the past, traditional roadside billboards have been covered with printed paper or printed plastic sheeting. Current plastic sheeting is either polyester scrim coated with a compounded PVC or woven polyethylene which may or may not require a printable coating layer commonly composed of inorganic powders such as antimony oxide, titanium oxide and/or calcium carbonate.

These types of plastic sheeting are then printed with an advertisement or message using solvent, water and UV-based inkjet digital printing technology.

These prints are used to cover over 400,000 billboard faces in the US which can be changed frequently, resulting in an estimated several hundred million square feet of material annually which must be printed, shipped, installed, removed, discarded and replaced.

Because billboards are located outside, they are subject to varying and, at times, extreme weather conditions, including sun, wind, rain, snow, ice, tornadoes, hurricanes. Older billboard structures may be made of wood and new billboard structures made of metal. These structures are also subject to wear and tear from the repeated attaching and removing of advertisements. As a result, the billboard structure may experience damage over time which can, in turn, impart physical damage to an installed advertisement. Such damage may lessen the life of an advertisement requiring the billboard owner to replace the advertisement at its cost or compelling the owner to use more robust, heavy duty material for the advertisement which adds additional cost.

SUMMARY OF THE INVENTION

Traditional roadside billboards are expensive for businesses to utilize in advertising. The goal of our invention is to reduce the cost of printed billboards and make this form of advertising more affordable and reduce the waste associated with replacing billboard advertising.

It is the object of the present invention to reduce the cost of printed billboard images as well as reduce the weight of these printed images which will, in turn, reduce shipping cost and improve worker safety for billboard installers. It will also reduce the waste when such billboard images are replaced.

The most significant reason for the high cost of printed billboards is the underlying print substrate material cost. A pre-printed roll of material is almost universally a thick, opaque, white material or substrate because white surfaces reflect all visible light spectrums equally, so an observer sees whatever color the source is. Advertising copy is printed directly on these thick, opaque materials.

Embodiments of the present disclosure utilize a white base surface or coating applied permanently or for extended periods of time on the billboard face and superimpose a separate image of advertising or messaging copy changes printed on a very thin, translucent color layer. It is the separate print image that is applied, removed and replaced while the white base or coating remains.

According to aspects of the present disclosure, the need to repeatedly ship an expensive print image with a heavy, opaque white base surface is eliminated because the billboard will maintain a face with a white surface and this white base surface will be reused over and over. Therefore, an extremely lightweight material that weighs up to 75% less than traditionally printed billboard messages will be printed and shipped and that will save costs throughout the supply chain, both in raw material cost and in shipping. Additionally, billboard installers will have a lighter weight alternative that will improve worker safety during installation. Further still, upon replacement of the printed image less material will be removed and discarded reducing waste disposal.

According to aspects of the present disclosure, in at least one embodiment the print image surface is a translucent, PET printable material that is light-weight, tensionable and recyclable.

According to aspects of the present disclosure, in at least one embodiment the print image surface is installed just like a traditional billboard, using rods placed in perimeter pockets and ratchets to tension the surface.

According to aspects of the present disclosure, in at least one embodiment any solid white surface may be applied to an existing billboard face that eliminates the need to ship a printed image that contains this required white reflective quality and which reduces existing imperfections and damage on the billboard structure that can damage new advertisements. This reduces the cost to make, ship and install the advertisement. The range of solutions for the base coating include providing a painted white under layer surface, applying a self-adhesive white material to the billboard, such as vinyl used with bumper-stickers, and installing a wrapped textile to achieve the same effect. Other possibilities will likely occur to those of skill in the art upon review of the present disclosure and such possibilities are deemed to be within the scope of this disclosure.

According to aspects of the present disclosure, in at least one embodiment an under-layer surface wraps around a billboard face to provide a protective surface. This protective surface has multiple features including an edge-protecting slip surface that reduces friction and enables a wrinkle-free install of the print image surface. This protective under layer surface also covers irregularities and sharp features within the billboard face, which irregularities can cause the thin print image surface to snag, rip or tear (as might occur if one installed the printed image surface directly over a billboard face without this under layer surface). It should further be appreciated that, according to aspects of the present disclosure, the under-layer should be substantially void of visible markings that would be visible through the image layer and thereby change or distort the image layer in unintended ways. For example, instructions or other markings may be placed on the pockets which will not be visible on the front fact of the billboard display panel, but markings should be absent from the portion or area of the under-layer that covers the front face of the display panel.

According to aspects of the present disclosure, in at least one embodiment the image layer is a single layer of polypropylene or polyester and is recyclable.

According to aspects of the present disclosure, in at least one embodiment the image layer is a non-woven and non-knitted textile.

According to aspects of the present disclosure, in at least one embodiment the textile includes a polymer coating on one or two sides.

According to aspects of the present disclosure, in at least one embodiment the textile has a weight that does not to exceed 200-grams per square meter (gsm), in other embodiments the textile has a weight that does not exceed 150 gsm, in other embodiments the weight does not exceed 100 gsm, in still other embodiments the weight does not exceed 75 gsm and in still other embodiments the weight does not exceed 50 gsm.

According to aspects of the present disclosure, in at least one embodiment the textile includes an extrusion coating on one or two sides or a solution coating on one or two sides. The coating is applied before the image is printed on the image layer According to aspects of the present disclosure, in at least one embodiment the opaque white under-layer comprises a removable layer mounted to the billboard with mechanical fasteners, including tensioning straps, bars, snaps, hook and loop, adhesives, or other fastening options to connect the white layer to the billboard structure.

According to aspects of the present disclosure, in at least one embodiment the image layer comprises a removable layer mounted to the billboard with mechanical fasteners, including tensioning straps, bars, snaps, hook and loop, adhesives, or other fastening options to connect the white layer to the billboard structure.

There are at least three benefits of the under-layer surface: (1) to provide a reflective white surface to provide acceptable image quality, (2) print image surface protection by reducing friction and creating smooth edges and a smooth billboard face, and (3) reduction of waste upon change of the advertising or messaging on a billboard.

DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

While the following disclosure describes the invention in connection with those embodiments presented, one should understand that the invention is not strictly limited to these embodiments. Furthermore, one should understand that the drawings are not necessarily to scale, and that in certain instances, the disclosure may not include details which are not necessary for an understanding of the present invention, such as conventional details of fabrication and assembly.

DETAILED DESCRIPTION

Figure 1:
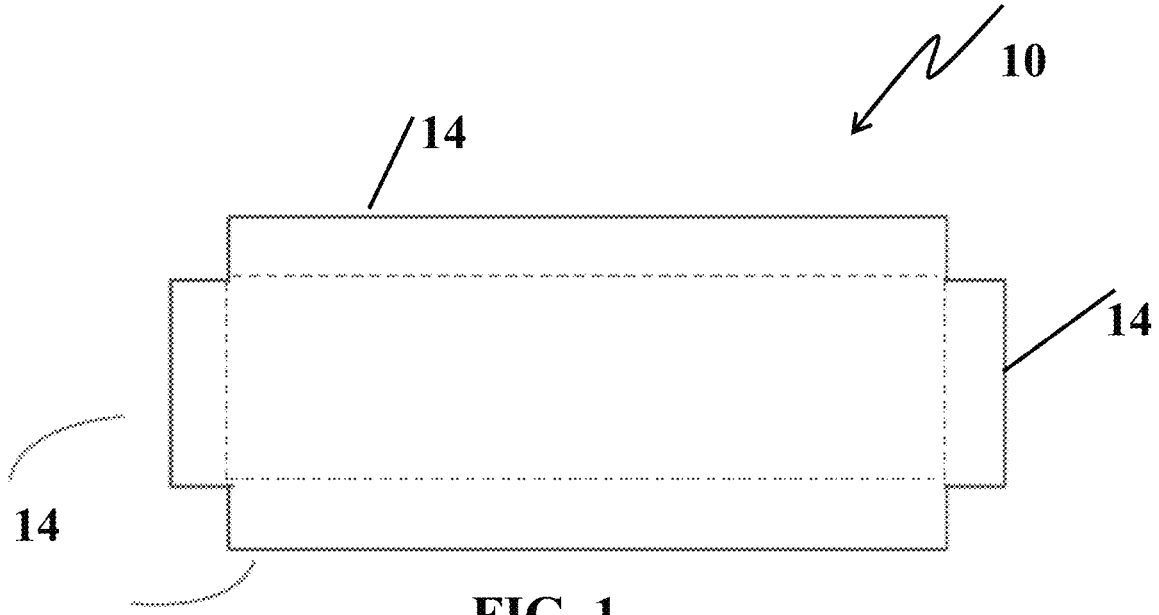
FIG. 1 is a top plan view of one embodiment of a white, opaque plastic sheeting used as an under-layer surface according to the present disclosure.

Turning to FIG. 1, one embodiment of an underlying layer 10 of an interchangeable billboard advertisement is shown. According to aspects of the present disclosure, the underlying layer 10 would typically be a lightweight, flexible material with a solid white coating. Perimeter pockets 14 are also illustrated.

Figure 2:
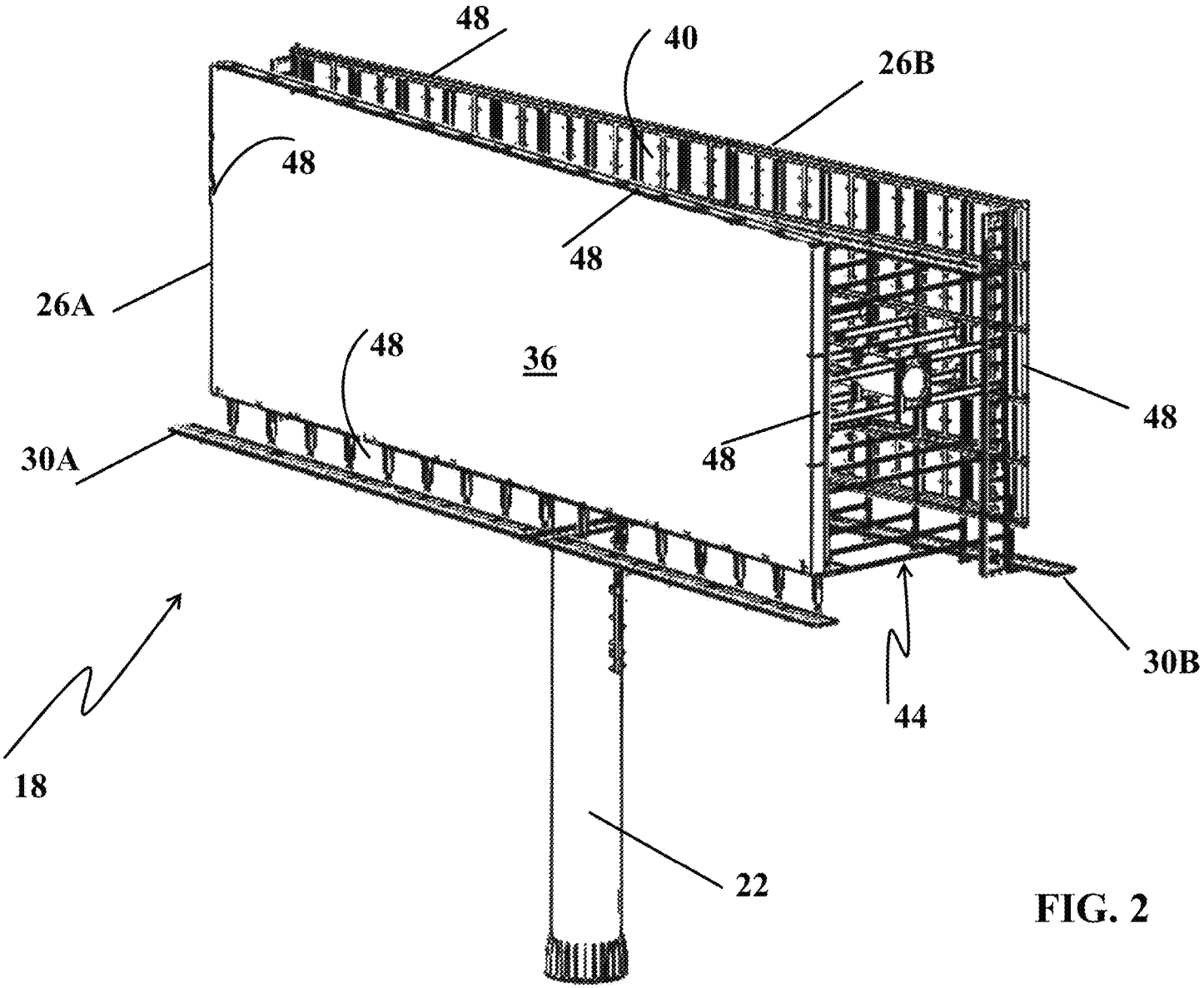
FIG. 2 is a perspective view of a dual billboard structure affixed to a single mounting pole.
Figure 3:
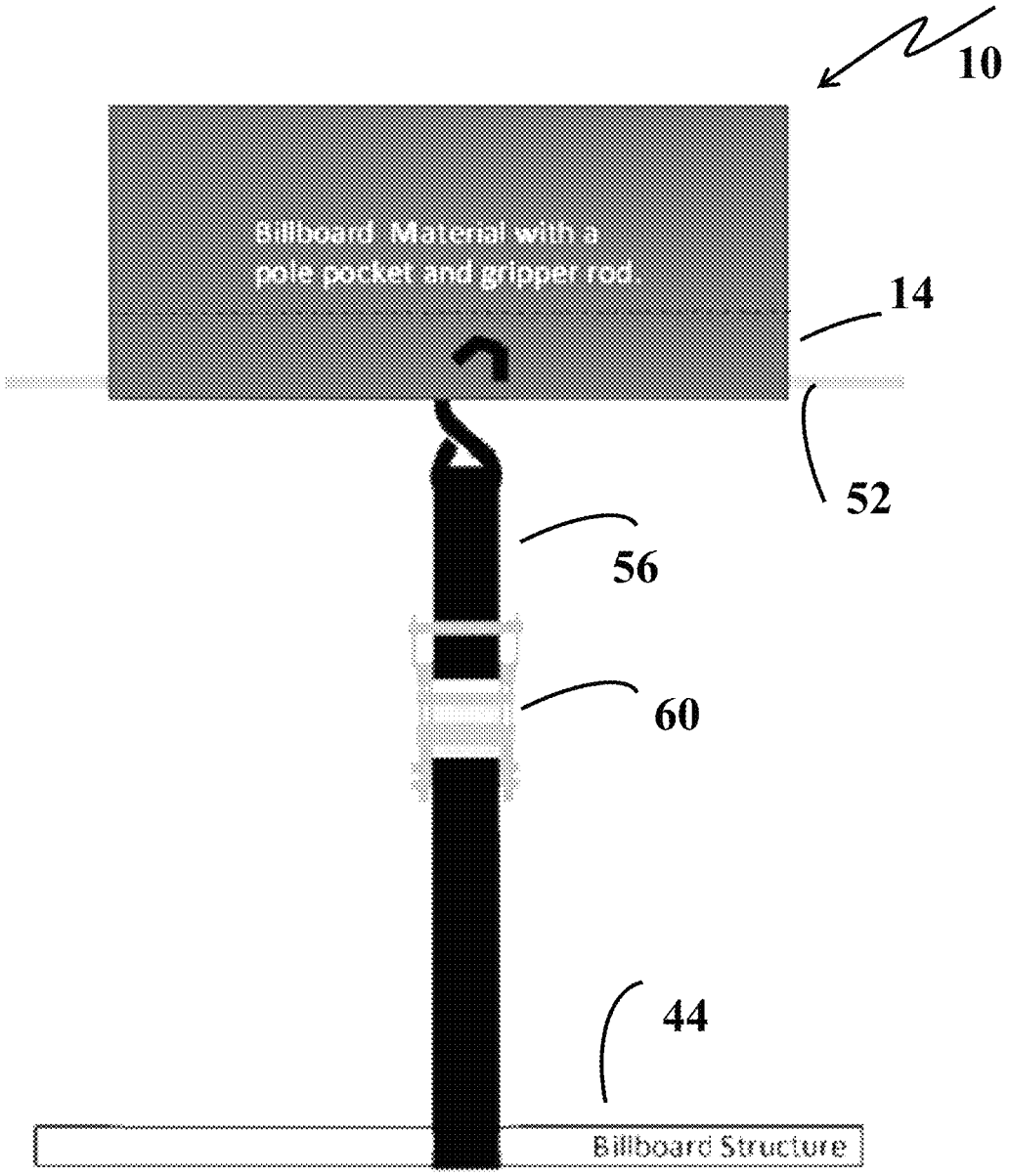
FIG. 3 is a block diagram of a traditional billboard installation method.
Figure 7:
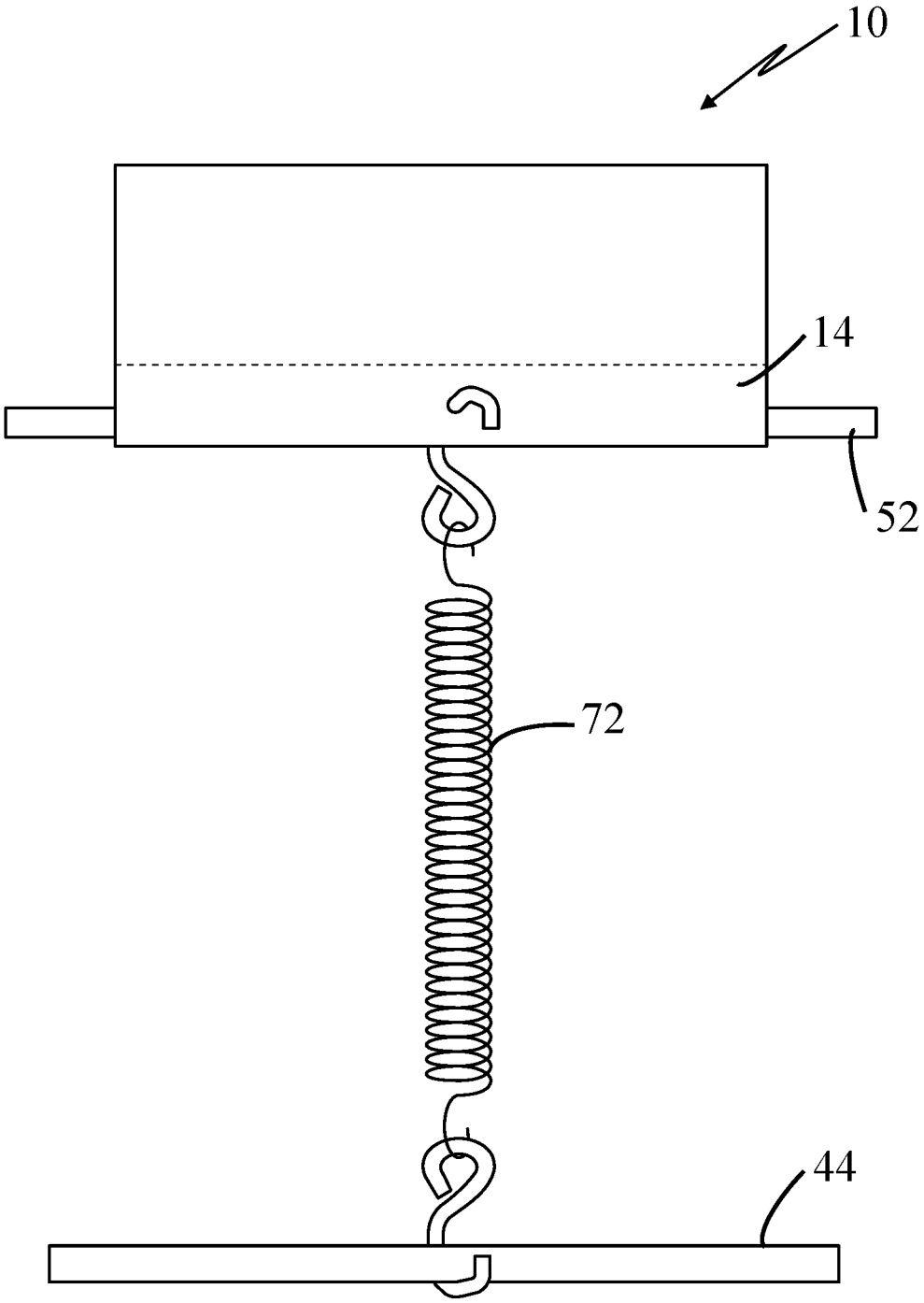
FIG. 7 is a block diagram of a spring tensioner for securing an underlaying layer or a image layer to a billboard structure.
Figure 8A:
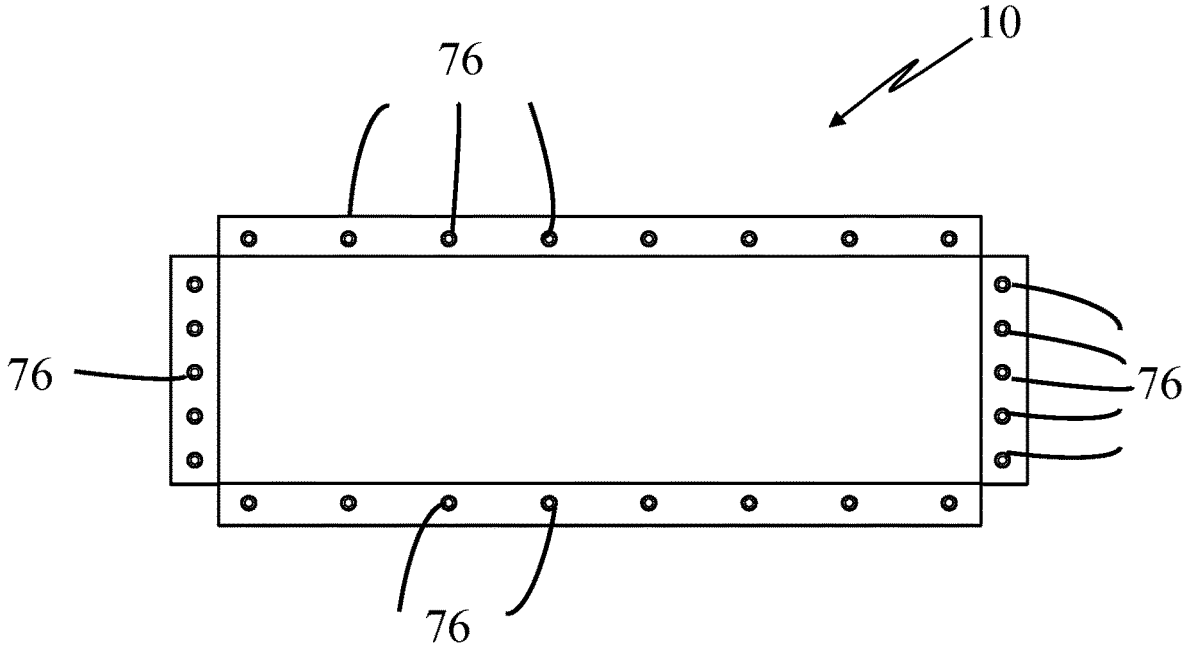
FIG. 8A is a plan view of the underside of an underlaying layer with the socket portion of multiple snaps secured to the underlaying layer.
Figure 8B:
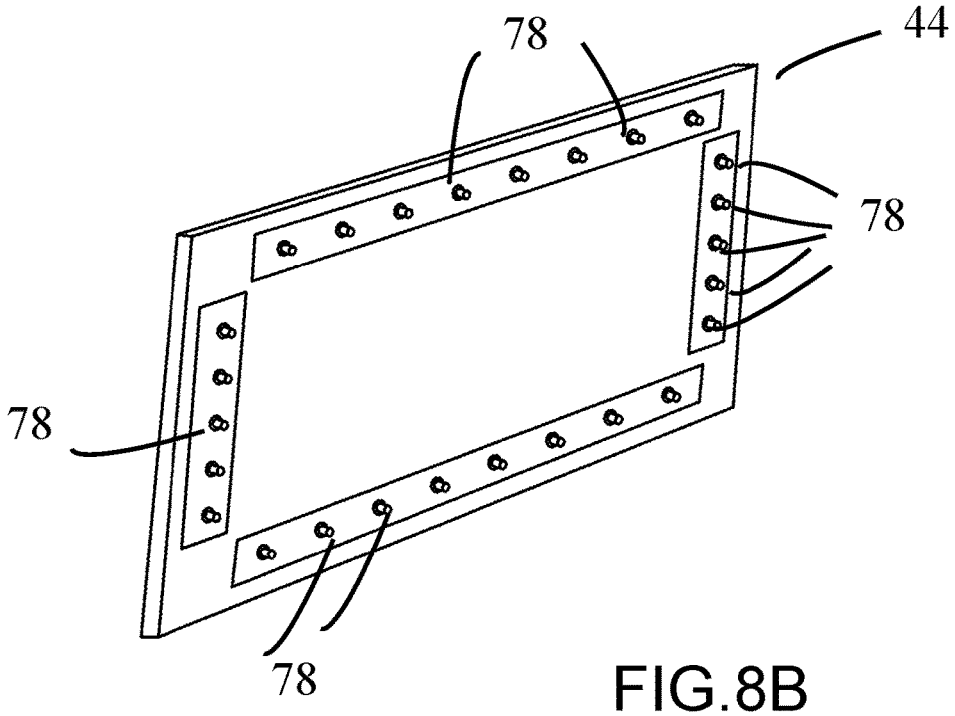
FIG. 8B is a perspective view of the backside of a billboard showing post portions of snaps affixed to the billboard structure and intended to mate with the socket portions shown in FIG. 8A.
Figure 9A:
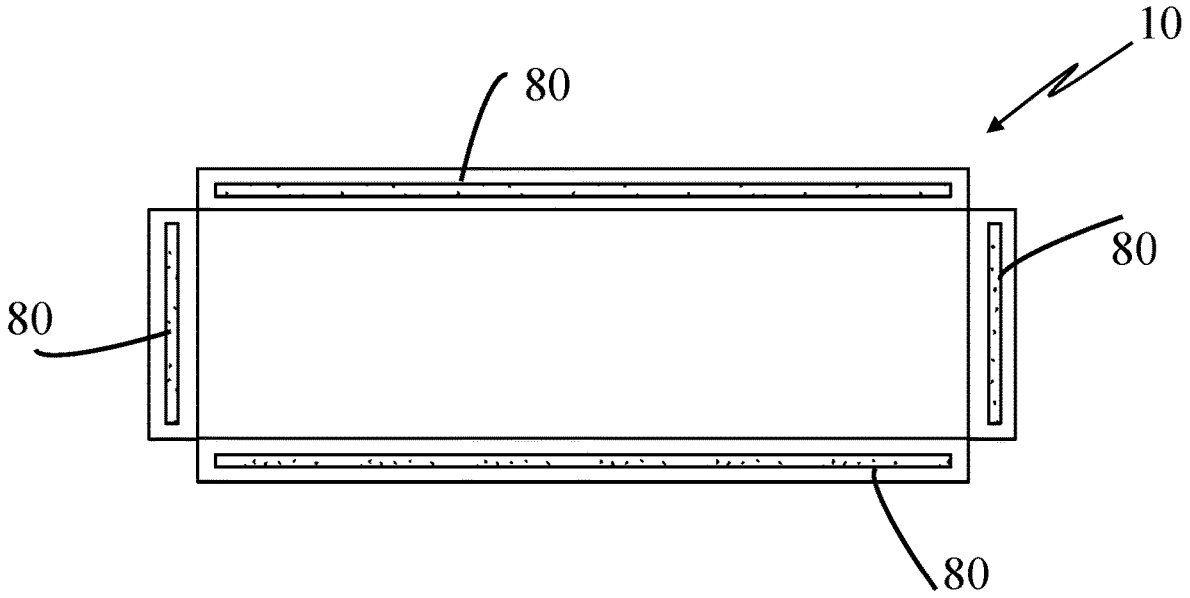
FIG. 9A is a plan view of the underside of an underlaying layer with loop fasteners affixed the underlaying layer.
Figure 9B:
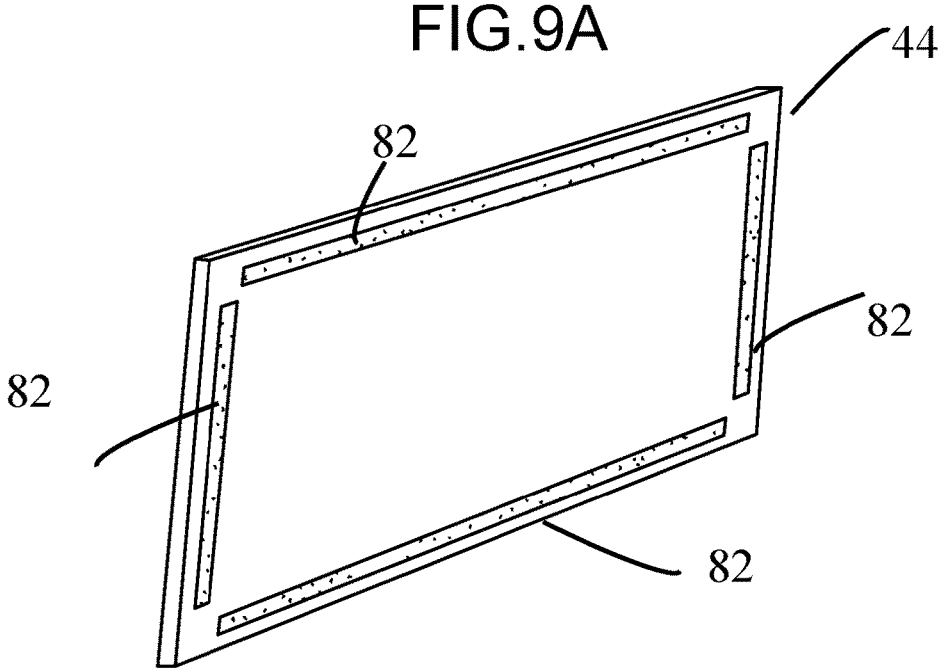
FIG. 9B is a perspective view of the backside of a billboard showing the hook fasteners affixed to the backside of the billboard structure and intended to mate with the fasteners of FIG. 9A.

As shown in FIG. 2, one embodiment of a billboard structure 18 is illustrated. The billboard structure 18 includes a support pole 22, a first panel 26A and second panel 26B and a first walkway 30A and a second walkway 30B. Each panel 26A and B has a front side 36 and a back side 40. A skeletal structure 44 supports each panel 26A and B. When installing the underlying layer 10 illustrated in FIG. 1, the underlying layer 10 is positioned on the front side 36 of the billboard panel 26A or 26B and the pockets 14 wrap around the edges 48 of the billboard panel 26. As shown in FIG. 3, tensioning rods 52 are positioned in the pockets 14 and are secured to the back side 40 of a billboard panel 26 with tensioning straps 56 secured to the skeleton structure 44. The straps 56 typically include an adjustment or tensioning mechanism 60 to apply increased tension to rods 52 positioned in each of the perimeter pockets 14. As those of skill in the art will understand, different tensioning mechanisms may be used in place of the tensioning mechanism 30 to achieve the same result. Such alternatives include but are not limited to straps, hook and loop fasteners and adhesives. An example of a spring tensioning mechanism is shown in FIG. 7 where a tension spring 74 extends between the billboard structure 44 and a tensioning rod 52 disposed in the pocket 14 of an underlying layer 10. An example of a snap attachment mechanism is shown in FIGS. 8A and 8B. FIG. 8A shows a plurality of socket portions 76 attached to the underside an underlying layer 10. FIG. 8B illustrates post members 78 affixed to the backside of the billboard structure 44. Interconnecting the socket and post members secures the underlying layer to the billboard structure. It should be appreciated that the sockets may alternatively be affixed to the billboard structure and the post members affixed to the underlying layer. A hook and loop fastener arrangement is show in FIGS. 9A and 9B. FIG. 9A illustrates loop fasteners 80 attached to the underside of the underlying layer 10. FIG.

Figure 10:
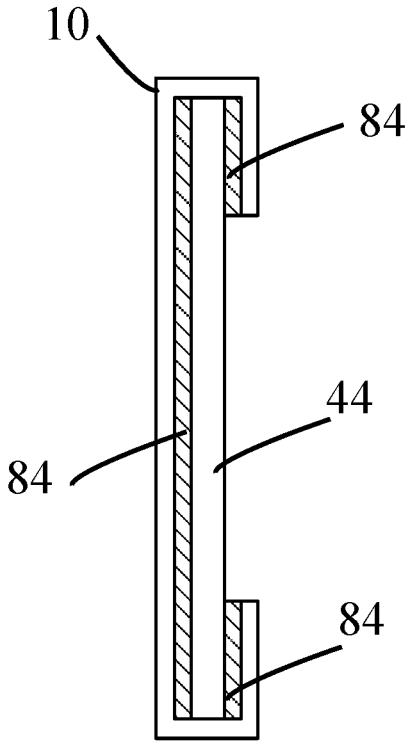
FIG. 10 is a cross section of a billboard showing an underlay affixed to the billboard by an adhesive layer.

9B illustrates hook fasteners 82 attached to the backside of a billboard structure 44. Interconnecting the loop and hook fasteners secures the underlying layer to the billboard structure. It should be appreciated that the loop members 80 may alternatively be affixed to the billboard structure and the hook fasteners 82 affixed to the underlying layer. FIG. 10 illustrates an underlaying layer 10 attached to a billboard structure 44 by an adhesive 84.

Figure 4:
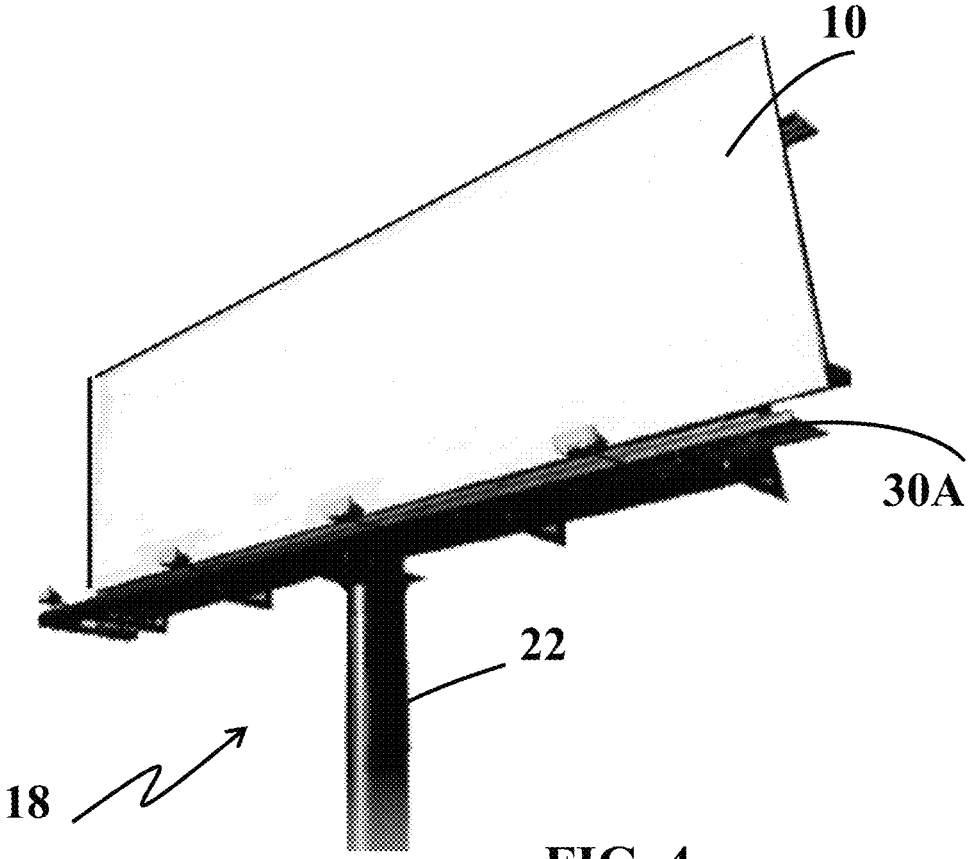
FIG. 4 depicts a white under layer surface according to aspects of the present disclosure installed on a typical billboard structure.

FIG. 4 illustrate a billboard structure 18 with the under-layer structure 10 affixed to the billboard structure 18.

Figure 5:
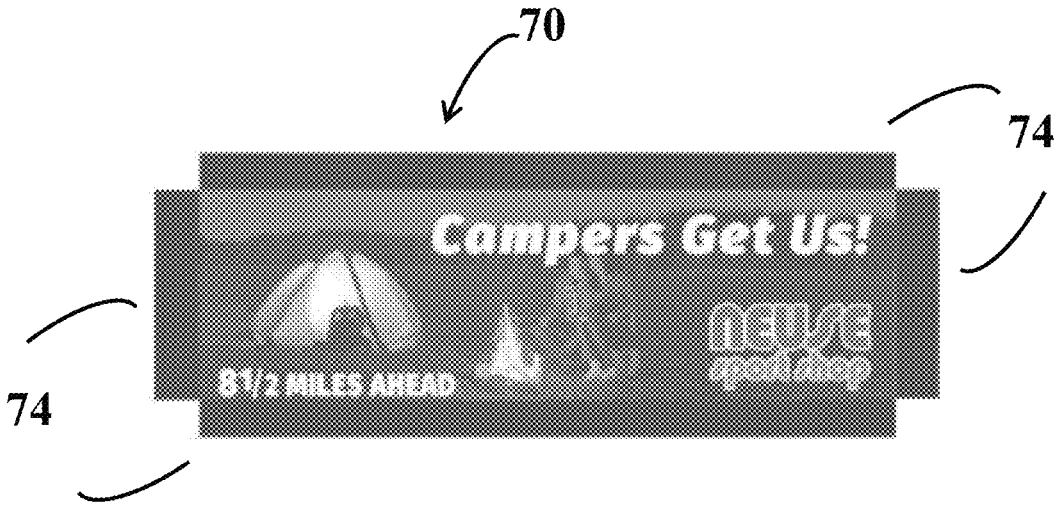
FIG. 5 is a perspective view of a printed billboard image with perimeter pockets.

FIG. 5 illustrates one embodiment of a billboard image layer 70. The image layer is provided on a light weight, flexible material, and includes a main body portion 72 containing the image or message to be conveyed, and perimeter pockets 74. Examples of acceptable material include a translucent non-woven and non-knitted textile, including but not limited to polyester and polypropylene. The image may be printed onto the material using printing techniques known to those of ordinary skill in the art, such as ink jet printing, dye sublimation printing, lithographic or silkscreen printing. The image may be one or more a word, a design, a logo, a symbol, an object, an animal and a person. A polymer coating may be applied to either or both sides of the image layer before printing to enhance the printing process or following printing to provide a protective coating to reduce the effect of weather and wear and tear.

Figure 6:
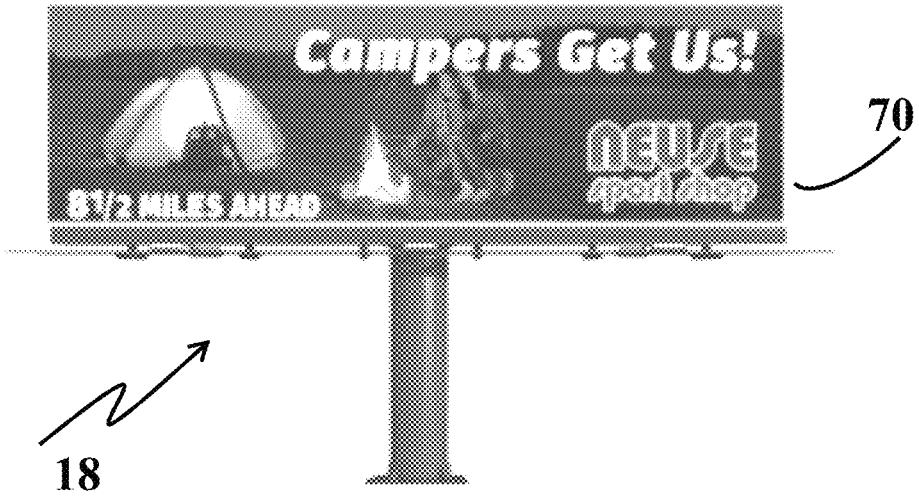
FIG. 6 is a perspective view of the billboard image of FIG. 5 installed on top of an under-layer surface of the type illustrated in FIG. 1 on a billboard structure.

FIG. 6 is a front plan view of the billboard image 70 of FIG. 5 installed on a billboard structure 18. The image material 70 is installed over an under-layer material 10. Fiberglass rods or similar structures are positioned in the pockets and secured to the backside of a billboard with tensioning mechanisms as discussed above with respect to the underlayer 10. The pockets 74 wrap around the edges of a billboard panel and are typically not visible from the front side of the panel. As an alternative to using the under-layer 10, the front face and edges of a billboard panel may be covered with a white paint or white vinyl or similar base coating. The base provided by the under-layer 10 or paint or vinyl coating provides a long-lasting surface to the front face of a billboard panel that need not be changed when the advertising image 70 is changed. The base coating reduces rough or sharp edges and imperfections in the face of the billboard that can damage an advertising message when applied and provides a smoother surface against which the image surface 70 may move or shift with a reduced likelihood of damage. In turn, by utilizing a base coating, the image material 70 may be made from less expensive and less robust material than is the case of traditional billboard advertising material which is plastic sheeting with either polyester scrim coated with a compounded PVC or woven polyethylene.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. It is to be understood that the phraseology and terminology used herein is for the purpose of description and should not be regarded as limiting.

What is claimed is:

1. A billboard display system comprising:

a billboard structure having at least one area defining a display face;

an opaque white under layer surface positioned over the display face, the under-layer surface substantially void of visible markings;

a translucent, digitally printed image layer, wherein the translucent printed image surface is installed over the white, opaque under layer surface.

2. The billboard display system of claim 1, wherein the opaque white layer comprises at least one of a painted surface and a layer of white material affixed to the billboard structure and configured to cover the display face.

3. The billboard display system of claim 2, wherein the opaque white layer is removably affixed to the billboard structure with mechanical fasteners.

4. The billboard display system of claim 3, wherein the fasteners comprise tensioning straps, spring tensioners, pole tensioners, snaps, hook and loop fasteners, and adhesives.

5. A method for providing advertising on a billboard, the billboard having a display face for receiving advertising, comprising:

securing a white under-layer to the billboard to cover at least a portion of the display face;

securing a first image layer over the white under layer, wherein the first image layer is a translucent material with an image applied to the translucent material.

6. The method of claim 5, further comprising:

allowing a period of time to elapse following securing the first image layer;

removing the first image layer; and securing a second image layer over the white under-layer, wherein the second image layer is a translucent material with an image applied to the translucent material.

7. The method of claim 6, wherein the white under-layer comprises one of a flexible textile, white paint and a white vinyl.

8. The method of claim 6, further comprising applying at least one of a polymer coating, an extrusion coating and a solution coating to the first image layer.

9. The method of claim 8, wherein the at least one of a polymer coating, extrusion coating and solution coating is applied to the first image layer before an image is applied to the first image layer.

10. The method of claim 9, wherein the at least one of a polymer coating, extrusion coating and solution coating is applied to the first image layer after an image is applied to the first image layer.

* * * * *